US009568013B2

(12) United States Patent
Tomter

(10) Patent No.: US 9,568,013 B2
(45) Date of Patent: Feb. 14, 2017

(54) METHOD FOR MOMENTARY HYDROSTATIC OPERATION OF HYDRODYNAMIC THRUST BEARINGS IN A VERTICAL FLUID DISPLACEMENT MODULE

(71) Applicant: Vetco Gray Scandinavia AS, Sandvika (NO)

(72) Inventor: Ole Petter Tomter, Nesøya (NO)

(73) Assignee: Vetco Gray Scandinavia AS, Sandvika (NO)

( * ) Notice: Subject to any disclaimer, the term of this patent is extended or adjusted under 35 U.S.C. 154(b) by 323 days.

(21) Appl. No.: 14/291,153

(22) Filed: May 30, 2014

(65) Prior Publication Data

US 2014/0270608 A1 Sep. 18, 2014

Related U.S. Application Data

(62) Division of application No. 13/329,767, filed on Dec. 19, 2011, now Pat. No. 8,752,674.

(30) Foreign Application Priority Data

Dec. 17, 2010 (NO) ..... 20101770

(51) Int. Cl.
*F04D 29/041* (2006.01)
*E21B 41/00* (2006.01)
(Continued)

(52) U.S. Cl.
CPC ..... *F04D 29/0413* (2013.01); *E21B 41/0007* (2013.01); *F01C 21/02* (2013.01);
(Continued)

(58) Field of Classification Search
CPC ..... F01M 1/02; F02B 61/045; F02B 75/007; F04C 29/02; F04C 13/008; F04C 14/24; F04C 15/0034; F04C 15/0092; F04C 15/008; F04C 2/16; F04C 2240/54; F16N 7/366; F16N 13/20; F04D 29/0413; F04D 29/0513; E21B 41/0007; F01C 21/02; Y10T 137/0318; Y10T 137/85978
(Continued)

(56) References Cited

U.S. PATENT DOCUMENTS 2,218,937 A 10/1940 Myers et al.
2,423,436 A 7/1947 Blom
(Continued)

FOREIGN PATENT DOCUMENTS

CN 1831341 A 9/2006
NO 20100902 A 12/2011
(Continued)

OTHER PUBLICATIONS

Unofficial English Translation of Chinese Office Action issued in connection with corresponding CN Application No. 201110435934.4 on Jun. 3, 2015.
(Continued)

*Primary Examiner* — Michael Riegelman
(74) *Attorney, Agent, or Firm* — GE Global Patent Operation

(57) ABSTRACT

A method for axial support of a pump or compressor rotor shaft during start-up or shut-down of a vertical fluid displacement module for subsea operation including a motor and a pump or compressor. Lubrication fluid is momentarily supplied for hydrostatic operation of hydrodynamic thrust bearing(s) from a topside or land-based fluid supply via a flow control module arranged in conjunction with a subsea pressure control unit configured for controlling the supply and discharge of barrier and lubrication fluids to/from the fluid displacement module.

6 Claims, 2 Drawing Sheets

Figure 1:
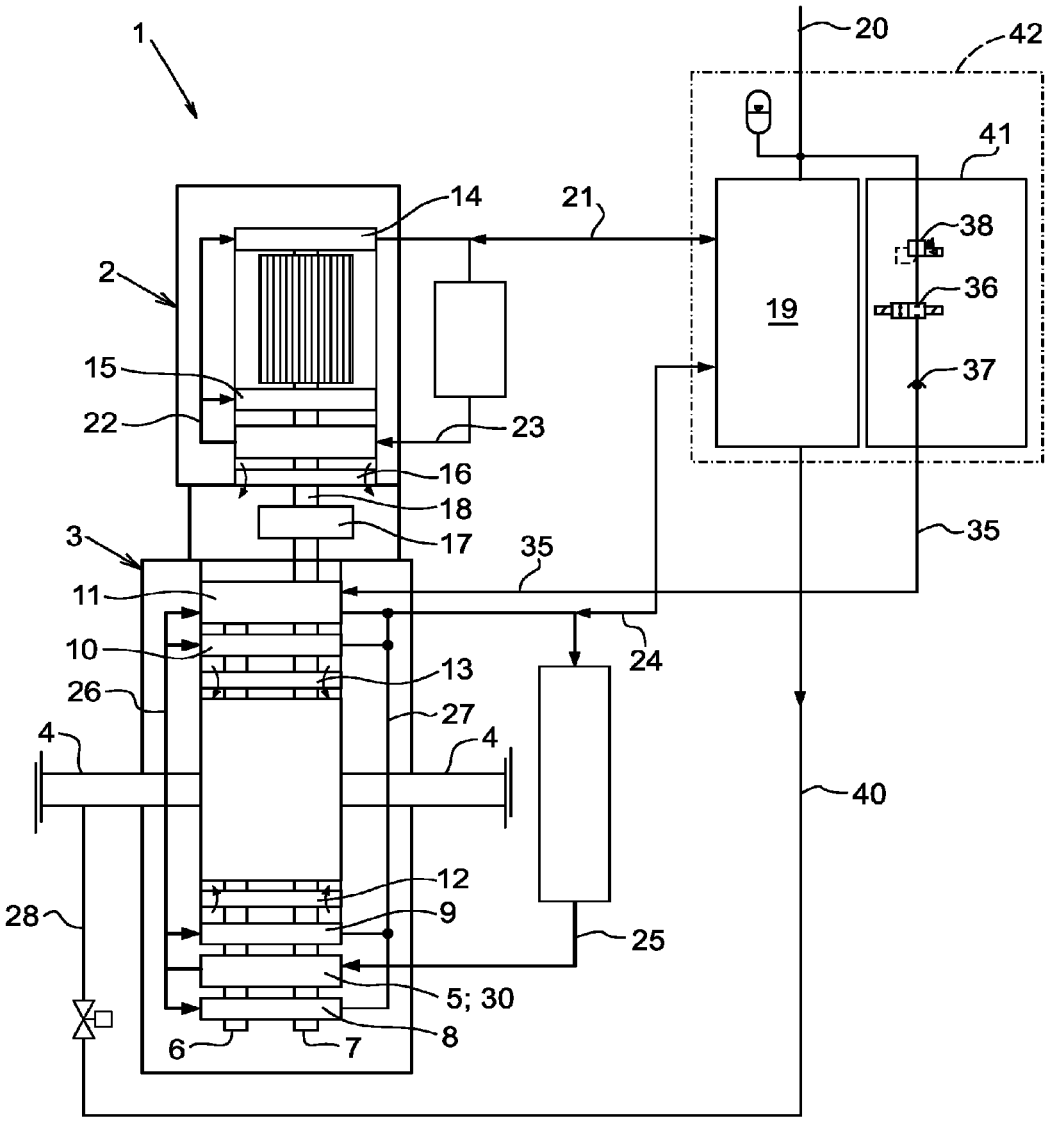

(51) Int. Cl.

| | |
|---|---|
| ***F01C 21/02*** | (2006.01) |
| ***F04C 13/00*** | (2006.01) |
| ***F04C 14/24*** | (2006.01) |
| ***F04C 15/00*** | (2006.01) |
| ***F04D 29/051*** | (2006.01) |
| *F04C 2/16* | (2006.01) |

(52) U.S. Cl.
CPC ..... *F04C 13/008* (2013.01); *F04C 14/24* (2013.01); *F04C 15/0034* (2013.01); *F04C 15/0092* (2013.01); *F04D 29/0513* (2013.01); *F04C 2/16* (2013.01); *F04C 15/008* (2013.01); *F04C 2240/54* (2013.01); *Y10T 137/0318* (2015.04); *Y10T 137/85978* (2015.04)

(58) Field of Classification Search
USPC ..... 184/6.16, 6.28, 6.15; 137/1, 565.01; 417/228, 365, 423.13, 424
See application file for complete search history.

(56) References Cited

U.S. PATENT DOCUMENTS

| | | | | |
|---|---|---|---|---|
| 2,682,229 | A | 6/1954 | Luenberger | |
| 3,163,790 | A | 12/1964 | White | |
| 3,617,156 | A | 11/1971 | Schiele et al. | |
| 3,947,153 | A | 3/1976 | Matthias et al. | |
| 4,227,865 | A | 10/1980 | Erickson et al. | |
| 4,276,002 | A | 6/1981 | Anderson | |
| 4,350,911 | A | 9/1982 | Wilson et al. | |
| 4,477,235 | A | 10/1984 | Gilmer et al. | |
| 4,545,741 | A | 10/1985 | Tomioka et al. | |
| 4,575,315 | A | 3/1986 | Galais et al. | |
| 4,614,482 | A | 9/1986 | Gaffal | |
| 4,932,848 | A | 6/1990 | Christensen | |
| 5,209,495 | A * | 5/1993 | Palmour | F04B 53/164 277/500 |
| 5,217,234 | A * | 6/1993 | Hornsby | F16J 15/3404 277/366 |
| 5,484,267 | A * | 1/1996 | Rockwood | F16J 15/3404 137/563 |
| 5,746,435 | A * | 5/1998 | Arbuckle | F16K 37/0091 277/304 |
| 5,769,427 | A * | 6/1998 | Ostrowski | F04D 29/128 277/318 |
| 5,795,135 | A | 8/1998 | Nyilas et al. | |
| 6,012,898 | A | 1/2000 | Nakamura et al. | |
| 6,059,539 | A | 5/2000 | Nyilas et al. | |
| 6,082,737 | A * | 7/2000 | Williamson | F16J 15/3492 277/317 |
| 6,116,609 | A * | 9/2000 | Azibert | F16J 15/3488 277/388 |
| 6,158,967 | A * | 12/2000 | Dupre | F04B 9/1372 277/300 |
| 6,161,835 | A * | 12/2000 | Arbuckle | F16J 15/3296 277/320 |
| 6,196,809 | B1 | 3/2001 | Takahashi et al. | |
| 6,599,091 | B2 | 7/2003 | Nagle | |
| 6,655,932 | B1 | 12/2003 | Stinessen et al. | |
| 7,481,270 | B2 | 1/2009 | Shepler | |
| 7,708,534 | B2 | 5/2010 | Parmeter et al. | |
| 8,087,901 | B2 | 1/2012 | Maier | |
| 8,313,316 | B2 | 11/2012 | Bade et al. | |
| 2008/0223467 | A1 | 9/2008 | Tveita | |
| 2009/0010773 | A1 | 1/2009 | Parmeter et al. | |
| 2013/0146299 | A1 | 6/2013 | Tomter | |
| 2014/0147299 | A1 | 5/2014 | Tomter | |

FOREIGN PATENT DOCUMENTS

| | | |
|---|---|---|
| WO | WO-9721055 A1 | 6/1997 |
| WO | WO-0073621 A1 | 12/2000 |
| WO | 2008115064 A1 | 9/2008 |

OTHER PUBLICATIONS

European Search Report and Written Opinion issued in connection with corresponding EP Application No. 11010314.0-1608 dated Aug. 7, 2015.
Norwegian Search Report—Jul. 5, 2011.

* cited by examiner

METHOD FOR MOMENTARY HYDROSTATIC OPERATION OF HYDRODYNAMIC THRUST BEARINGS IN A VERTICAL FLUID DISPLACEMENT MODULE

CROSS-REFERENCE TO RELATED APPLICATIONS

This application is a divisional application of co-pending U.S. patent application 13/329,767 filed 19 Dec. 2011 and claims priority to Norwegian patent application 20101770 filed 17 Dec, 2010.

TECHNICAL FIELD OF THE INVENTION

The present invention refers to a system and a method for momentary hydrostatic operation of hydrodynamic thrust bearings for rotors in pumps or compressors designed to be operated in the underwater production of hydrocarbon fluids, wherein the pump or the compressor is driven by a motor and together with the motor arranged in a fluid displacement module having vertical orientation during operation, and in which barrier and lubrication fluids are circulated to prevent ingress of seawater and production fluids into cavities, seals and bearings of the fluid displacement module.

BACKGROUND AND PRIOR ART

Pumps and compressors operated in the recovery of hydrocarbon products at great sea depths are subjected to a harsh environment including e.g. high pressures in the order of well over 100 bar. In order to prevent ingress of liquid, gas and solid particles into the motor and pump/compressor structures, hydraulic fluid at slightly higher pressure is circulated through the structures to provide lubrication and barriers that prevent intrusion of harmful matter. Typically, barrier and lubrication fluid is circulated through the motor structure at a first pressure, and barrier and lubrication fluid is circulated through the pump or compressor structure at a pressure that is slightly lower than the pressure in the motor fluid circuit. A pressure difference of about 5-10 bar is often applied and sufficient to separate the motor and pump/compressor fluid circuits, and the same pressure difference can be applied to separate the barrier and lubrication fluid circuits from the production fluid in the pump or compressor.

The motors, pumps or compressors used for this purpose are heavy duty designs requiring considerable power to bring the pump's or compressor's rotor(s) in rotation, as well as long life bearings to take up thrust load applied to the rotor by its weight and from the production fluid. Once in rotation lubrication fluid is pressurized and fed by the rotor or by means associated with the rotor to supply tilted pads of a thrust bearing to allow for hydrodynamic lubrication film build-up and thereby to keep thrust-engageable surfaces separated with a fluid film flow between the surfaces.

At stand still, the thrust-engageable surfaces may come into contact under the weight of the rotor, e.g., or in result of the static pressure in the pumped medium at stand still. Changeover from rotation to non-rotation and vice versa, i.e. at start-up and shut-down, imposes a problem as the hydrodynamic operation of the thrust bearing fails when the rotor speed is insufficient for separating the thrust-engageable surfaces. At start-up and shut-down, rotation of the "dry" bearing causes wear of the thrust-engageable surfaces. Start-up of a pump or a compressor with dry bearings results initially in a very high torque demand, which calls for a corresponding over-sizing of the subsea power distribution grid, motor and transformers, etc.

SUMMARY OF THE INVENTION

The present invention aims to avoid the problems of wear of thrust bearings and provides a solution that reduces the torque requirement and thereby the power and current requirement at start up of the motor and pump/compressor module.

The object is met in a system for momentary hydrostatic operation of hydrodynamic thrust bearings in a vertical fluid displacement module for subsea operation comprising a motor and a pump or compressor, wherein said module is connected to a pressure control unit located subsea and arranged for controlling the supply and the discharge of barrier and lubrication fluids to and from said module. Barrier and lubrication fluid is circulated within the motor at a first pressure in a barrier and lubrication fluid circuit, and barrier and lubrication fluid is circulated within the pump/compressor in a barrier and lubrication fluid circuit at a second pressure lower than said first pressure.

A fluid supply line is arranged, connecting a flow control unit and hydrodynamic thrust bearing(s) in the pump/compressor, and flow control means in the fluid supply line is controllable for momentarily supplying fluid to the thrust bearing(s) at a pressure sufficient to generate a fluid film between thrust-engageable surfaces in the thrust bearing(s) at start-up and shut-down, respectively, of the pump/compressor. A fluid communication is arranged for discharge of fluid from the thrust bearing(s) to the barrier and lubrication fluid circuit in the pump/compressor, whereby fluid flow (driving pressure) between the thrust-engageable surfaces at start-up and shut-down, respectively, is generated in response to fluid discharge from the pressure control unit to a process fluid flow.

Through this arrangement it is ensured that hydraulic fluid is instantly available at sufficient pressure and volume for separation of the thrust-engageable surfaces at start-up and shut-down of the pump or compressor. The discharge of fluid from the bearing(s) via the pump/compressor barrier and lubrication fluid circuit and the pressure control unit further ensures that appropriate pressure difference between the barrier and lubrication fluid circuits of the motor and the pump/compressor, respectively, can be maintained through pressure control in the pressure control unit. By arranging fluid supply to the bearing(s) from a flow control unit located subsea there is achieved fast response and a compact structure.

In a preferred embodiment the flow control means comprises a flow control valve, such as an on/off control valve, and a check valve arranged in series in the fluid supply line connecting to the thrust bearing(s). In addition, the flow control means may comprise a pressure regulating valve. The pressure regulating valve may be associated with an electrical motor drive allowing for remote adjustment of the hydrostatic pressure supply level.

The flow control means may be housed inside a subsea flow control unit, or in the pressure control unit, both of which may be arranged as retrievable units of the system.

Preferably, hydrostatic operation of the thrust bearings is managed from topside via electrically responsive flow control means.

Hydrodynamic operation of the thrust bearing(s) may include supply of hydraulic fluid from the pressure control unit (via the supply line connected to fixed pads of the thrust bearing(s)).

Hydrostatic operation of the thrust bearing(s) may include supply of hydraulic fluid from the flow control unit to fixed pads included in the thrust bearing(s).

The pressure control unit is connected to the process fluid flow on the inlet side or on the outlet side of the pump/compressor for discharge of fluid into the process fluid flow.

A system as briefly described above thus comprises means for practising a method for axial support of a pump or compressor rotor shaft during start-up or shut-down of a vertical fluid displacement module for subsea operation comprising a motor and a pump or compressor, comprising the step of momentarily supplying lubrication fluid for hydrostatic operation of hydrodynamic thrust bearing(s) from a topside or land-based fluid supply via flow control means arranged in conjunction with a subsea pressure control unit configured for controlling the supply and discharge of barrier and lubrication fluids to/from said module.

Further advantages as well as advantageous features of the subsea system and method according to the present invention will appear from the dependent claims and the following description.

SHORT DESCRIPTION OF THE DRAWINGS

Figure 2:
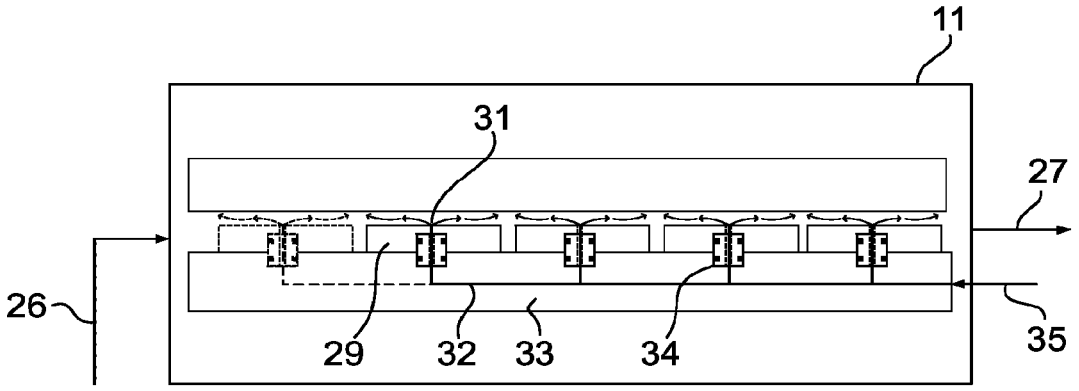
Figure 3:
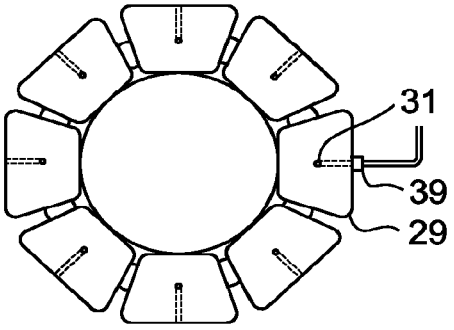

The present invention will be more closely explained below with reference made to the accompanying drawings, schematically illustrating a subsea system implementing the invention. In the drawings, FIG. 1 illustrates a system setup for momentary hydrostatic operation of a hydrodynamic thrust bearing in a vertical fluid displacement module for subsea operation;

FIG. 2 is a sectional view through a thrust bearing, schematically illustrating the supply of hydraulic fluid for hydrostatic operation, and FIG. 3 is an end view of a thrust bearing illustrating the supply of hydraulic fluid for hydrostatic operation.

DETAILED DESCRIPTION OF PREFERRED EMBODIMENTS

In the drawing of FIG. 1, a fluid displacement module generally referred to by reference number 1, defines within its margin a motor unit 2 and a fluid displacement unit 3. In operation, the fluid displacement module 1 has an upright or vertical orientation as illustrated. The fluid displacement unit 3 may comprise a pump which effects displacement of a process fluid, or may comprise a compressor which effects pressurization of a fluid flow. The pump or compressor 3 typically has one or more rotors driven in rotation by the motor. The rotor(s) are journalled for rotation in a pump or compressor cavity which communicates with a process fluid line via an inlet and outlet, respectively, in the schematic drawing of FIG. 1 commonly referred to as reference number 4.

The motor 2 and the pump or compressor 3 may be any conventional structure for subsea operation known to the skilled person. For the purpose of disclosing the invention, and without limitation to the disclosed embodiment, FIG. 1 illustrates an embodiment comprising a screw rotor pump having two screw rotors that are driven in rotation with intermeshing gears, or timing gears 5, that provide synchronization of the rotary motion. The rotor shafts 6, 7 are journalled in radial bearings 8, 9 and 10 in a pump housing, and the rotors are axially supported from a thrust bearing 11. The rotor bearings are separated from the pump medium by seal arrangements 12 and 13 at both ends of the rotors.

The motor 2 is arranged in a motor housing that protects the motor from the ambient sea. In the motor housing, the motor shaft is journalled for rotation in radial bearings 14 and 15. Although not shown in the drawing, thrust bearings may be arranged also in the motor housing to take up axial loads on the motor shaft. The motor housing interior is hydraulically separated from the pump housing interior by a seal arrangement 16, through which the motor shaft extends to be drivingly connected with the rotors via a flexible coupling 17.

A hydraulic fluid in the motor housing is controlled at a pressure above the internal pressure of the pump, acting as a barrier which prevents intrusion of process fluid and particles into the motor housing via the seal arrangement 16 sealing about the motor shaft 18. In result of the pressure difference, a leak flow of hydraulic fluid along the motor shaft is unavoidable. The leakage rate is dependent on fluid properties, differential pressure, the transient operating conditions of the pump, and the tightness of the seal(s). The leakage is compensated by refilling the motor housing from an external supply of hydraulic fluid. Likewise, hydraulic fluid is used for lubrication of pump bearings and timing gears. The pressure in the pump lubrication fluid is to be maintained above the pressure of the pumped medium internally of the pump, in order to prevent intrusion of process fluid and particles into pump bearings, seals and timing gears. Leakage via the pump seals into the pumped medium is compensated by refilling from an external supply of hydraulic fluid.

The volume and pressure management of hydraulic fluid supplied to the motor and pump units 2 and 3 is provided via a pressure control unit 19 to which fluid is supplied from topside in a fluid line 20. The pressure control unit 19 operates as a barrier and lubrication fluids pressure regulation means supplying or discharging barrier and lubrication fluid to/from the subsea motor and pump/compressor module 1. To this purpose motor barrier and lubrication fluid is circulated in a fluid circuit 21, 22, 23 providing supply and discharge of barrier and lubrication fluid to the motor and the motor shaft bearings. Flow of hydraulic fluid inside the motor unit 2 is conventionally generated by means of a pump or impeller (as indicated in FIG. 1 between 15 and 16, e.g.) rotating with the motor shaft. Likewise, pump/compressor barrier and lubrication fluid is circulated in a fluid circuit 24, 25, 26, 27 providing supply and discharge of barrier and lubrication fluid to the pump/compressor shaft bearings and timing gears. Flow of hydraulic fluid inside the pump/compressor unit is likewise typically generated by means of a pump or impeller rotating with the rotor/rotor shaft, such as lubrication pump 30 as indicated in FIG. 1. Barrier and lubrication fluid external coolers may be included in the fluid circuits 21-23 and 24-27 as conventional, as also indicated in FIG. 1.

The pressure control unit 19 may advantageously be configured as disclosed in applicant's previous Norwegian patent application No. 20100902, the contents of which is incorporated herein by reference.

In a preferred embodiment, the pressure control unit 19 thus comprises first and second pressure compensators and flow control valves (not shown in FIG. 1) operated in response to a demand for supply of hydraulic fluid based on changes in fluid pressure in the barrier and lubrication fluid circuits 21-23 and 24-27. The pressure compensators may be any available type of piston loading pressure compensator for use subsea, and designed for separating a pilot fluid from the hydraulic circuit to be controlled. In this embodiment, the control unit 19 provides the following operation in the system:

- the hydraulic fluid in the motor barrier and lubrication fluid circuit 21-23 is pre-tensioned towards the motor by a pressure applied from the first separating pressure compensator;
- the hydraulic fluid in the pump/compressor barrier and lubrication fluid circuit 24-27 is pre-tensioned towards the pump/compressor by a pressure applied from the second separating pressure compensator; wherein
- the second pressure compensator is responsive to the pumped medium pressure at a pump inlet and/or at a pump outlet (at a suction and/or discharge side of the pump) to apply the sum of that pressure and its inherent pre-tensioning pressure to the pump/compressor barrier and lubrication fluid circuit, and
- the first pressure compensator is responsive to the pressure in the pump/compressor barrier and lubrication fluid circuit to apply the sum of that pressure and its inherent pre-tensioning pressure to the motor barrier and lubrication fluid circuit.

In order to balance the pressures in the barrier and lubrication fluid circuits 21-23 and 24-27 relative to the pumped medium pressure, the pumped medium pressure is communicated to the pressure control unit 19 via pilot lines 40, 28 acting as pressure reference lines.

For the same purpose, the pressure control unit 19 may in another preferred embodiment comprise first and second pressure reducing regulators and pressure control valves (not shown in FIG. 1) as disclosed in applicant's previous Norwegian patent application No. 20100905, the contents of which is incorporated herein by reference. In the alternative embodiment, the pressure control unit 19 comprises:

- a pump/compressor barrier and lubrication fluid circuit 24-27 in flow communication with a hydraulic fluid supply via a first pressure reducing regulator;
- a motor barrier and lubrication fluid circuit 21-23 in flow communication with the hydraulic fluid supply via a second pressure reducing regulator, wherein
- the first pressure reducing regulator is configured to reduce the supply fluid pressure in response to the pumped medium pressure at the suction side or at the discharge side of the pump, and
- the second pressure reducing regulator is configured to reduce the supply fluid pressure in response to the output pressure of the first pressure reducing regulator.

A detailed explanation of the internals and operation of the pressure control unit 19 is available from the referenced and incorporated Norwegian patent applications.

Now looking closer to the structure of the rotor thrust bearing 11, see also FIG. 2. The thrust bearing 11 comprises rotationally fixed tilted pads 29 supporting axially the pump or compressor rotor. In operation, hydraulic fluid in the pump/compressor fluid circuit 24-27 is pressurized and fed to the thrust bearing by a rotating rotor, or by means driven by the rotor such as a lubrication pump 30 (see FIG. 1) associated with the timing gear assembly 5, e.g. This way, pressurized lubrication fluid is supplied to the tilted pads to generate, upon rotation, separation of the thrust-engageable surfaces by creation of a hydrodynamic fluid film between the pads 29 and opposing axial faces formed on or connected with the rotor. In this mode, the operation of the thrust bearing 11 is hydrodynamic.

In a pure hydrodynamic thrust bearing, the fluid pressure and flow of hydraulic fluid successively decreases with decreasing rotational speed of the rotor until thrust-engageable surfaces, i.e. the supporting pads in the bearing and opposing axial faces on the rotor, are brought into frictional contact during shut-down. In start-up from a stand-still mode the thrust-engageable surfaces rotate under frictional contact until rotor speed and resulting fluid pressure and flow is sufficient to separate the axial faces on the rotor from the pads.

According to the invention, the hydrodynamic thrust bearing 11 is momentarily operated as a hydrostatic bearing during start-up and shut-down until the rotor speed is sufficient to provide hydrodynamic operation. To this purpose hydraulic fluid is supplied to generate a fluid film at the interface between the pads and opposing axial faces on the rotor. Hydraulic fluid is supplied to this interface via apertures 31 formed through the pads 29. Each pad may be formed with an aperture 31 communicating hydraulic fluid to the interface from a common fluid cavity or channel 32 formed in a pad base 33 in which the pads are mounted. A sealed insert 34 provides fluid passage between each pad 29 and the pad base 33. The hydraulic fluid is supplied to the channel 32 in the pad base via a fluid supply line 35 connecting the thrust bearing 11 with the flow control unit 41. A flow control valve 36 in fluid supply line 35 controls the supply of hydraulic fluid to the thrust bearing 11. A check valve 37 in fluid supply line 35 prevents reverse flow. A pressure regulating valve 38 may additionally be provided to regulate the pressure of fluid supplied to the thrust bearing 11. The flow control valve 36, as well as the pressure regulating valve 38 if appropriate, is preferably electrically responsive to control signals from a topside control that operates the hydrostatic mode of the thrust bearing. The pressure regulating valve 38 may be associated with an electrical motor drive allowing for remote adjustment of the hydrostatic pressure supply level in the thrust-bearing lubrication fluid supply line 35.

FIG. 3 shows an alternative embodiment wherein hydraulic fluid is fed radially to the fixed pads 29. To this purpose each pad is formed with connecting axial and radial channels that connect the aperture 31 with a peripheral fluid connection 39 to which hydraulic fluid is supplied from the flow control unit 41.

Hydraulic fluid supplied via pad apertures 31 is allowed to leak into the pump/compressor barrier and lubrication fluid circuit 24-27. The resulting rise in pressure in the fluid circuit 24-27 is handled by the pressure control unit 19, from which excessive fluid is discharged to external recipient, typically to the process fluid flow via discharge line 40 which communicates reference pressure to the pressure control unit 19. The flow control unit 41 in this way provides a hydrostatic pressure between the pads 29 and opposing axial faces in the thrust bearing 11 at start-up and shut-down respectively. Further in result of communicating the hydrostatic pressure in the thrust bearing 11 via fluid circuit 24-27 to the pressure control unit 19, the pressure in the motor barrier and lubrication fluid circuit 21-23 is instantly balanced and maintained at the predetermined pressure above the pump/compressor barrier and lubrication fluid pressure in circuit 24-27, by the intrinsic operation of the pressure control unit 19 as previously explained.

The flow control means 36-38 may be arranged as a flow control unit in a separate housing 41 to which hydraulic fluid is supplied from topside. The flow control means 36-38 may alternatively be arranged together with the components of the pressure control unit 19 in a common housing 42 to which hydraulic fluid is supplied from topside. In both cases, the housings 41 or 42 may be connectable to the motor and pump/compressor module 1 through fast coupling means by which the housings are dismountable and retrievable, such as by means of a remotely operated vehicle ROV, e.g. Likewise, the pressure control unit 19 may be arranged dismountable and separately retrievable by means of a ROV, e.g.

The invention is of course not in any way restricted to the embodiments described above. On the contrary, many possibilities to modifications thereof will be apparent to a person with ordinary skill in the art without departing from the basic idea of the invention such as defined in the appended claims.

The invention claimed is:

1. A method for axial support of a pump or compressor rotor shaft during start-up or shut-down of a vertical fluid displacement module for subsea operation comprising a motor and a pump or compressor, the method comprising:

momentarily supplying, during the start-up or shut-down of the vertical fluid displacement module, lubrication fluid into hydrodynamic thrust bearing(s) for hydrostatic operation of the hydrodynamic thrust bearing(s) from a topside or land-based fluid supply via a flow control module arranged in cooperation with a subsea pressure control unit configured for controlling the supply and discharge of barrier and lubrication fluids to/from said vertical fluid displacement module.

2. The method according to claim 1, wherein the subsea pressure control unit is operated to generate a fluid film flow between pads of the hydrodynamic thrust bearing(s) and opposing axial faces on rotors in the pump or compressor, and wherein operation of the subsea pressure control unit comprises discharge of barrier/lubrication fluid from the subsea pressure control unit to the pump or compressor.

3. The method according to claim 1, wherein momentarily supplying the lubrication fluid into the hydrodynamic thrust bearing(s) comprises:

operating a flow control valve arranged in a thrust bearing lubrication fluid supply line connected to the hydrodynamic thrust bearing(s) in the pump or compressor.

4. The method according to claim 1, further comprising:

electrically controlling the flow control module from a topside control.

5. The method according to claim 1, further comprising:

controlling a supply pressure in a thrust bearing lubrication fluid supply line by a pressure regulating valve.

6. The method according to claim 1, further comprising:

supplying hydraulic fluid from the pump/compressor barrier and lubrication fluid circuit to the thrust bearing(s) in hydrodynamic operation of the thrust bearing(s).

* * * * *